United States Patent [19]

Jessamine

[11] 4,416,429

[45] Nov. 22, 1983

[54] WATER SKI TOW ROPE REEL APPARATUS

[76] Inventor: Donald W. Jessamine, 2341 S. Del Rio, Apache Junction, Ariz. 85220

[21] Appl. No.: 278,177

[22] Filed: Jun. 29, 1981

[51] Int. Cl.[3] ..... B65H 75/34; B65H 75/38; B65H 75/40

[52] U.S. Cl. ..... 242/86.5 A; 242/86.1; 242/96; 242/100.1; 242/107.1; 114/254

[58] Field of Search ..... 242/100.1, 107.1, 96, 242/84.8, 86.5 A, 86.5 R, 86.1, 167, 84.2 D, 84.2 J; 244/155 A; 24/71.2, 71.3; 191/12.4, 12.2 R; 114/254, 253; 33/138

[56] References Cited

U.S. PATENT DOCUMENTS

| | | | |
|---|---|---|---|
| 1,386,918 | 8/1921 | Westrup | 242/100.1 |
| 2,319,731 | 5/1943 | Garrett | 242/100.1 |
| 2,915,259 | 12/1959 | Force | 114/254 X |
| 3,006,020 | 10/1961 | Fillery | 242/84.2 R X |
| 3,041,996 | 7/1962 | Roberts | 114/254 |
| 3,113,547 | 12/1963 | Stewart | 242/86.5 A X |
| 3,311,319 | 3/1967 | Campbell | 242/84.8 X |
| 3,498,563 | 3/1970 | Palmien | 242/86.5 A |
| 4,322,045 | 3/1982 | Tellier | 242/100.1 |

*Primary Examiner*—Stuart S. Levy
*Assistant Examiner*—Lloyd D. Doigan
*Attorney, Agent, or Firm*—H. Gordon Shields

[57] ABSTRACT

Water ski tow rope apparatus includes a housing through which the tow rope extends and in which is disposed a reel on which the tow rope is wound for storage purposes.

5 Claims, 7 Drawing Figures

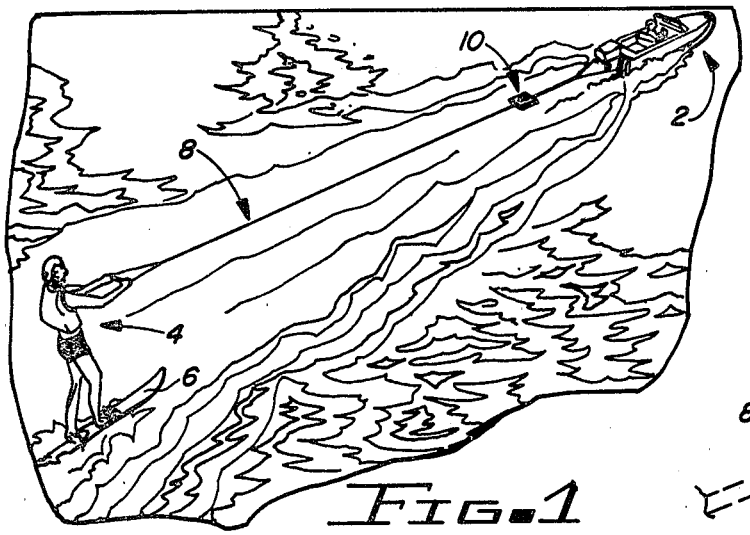
FIG. 1
FIG. 4
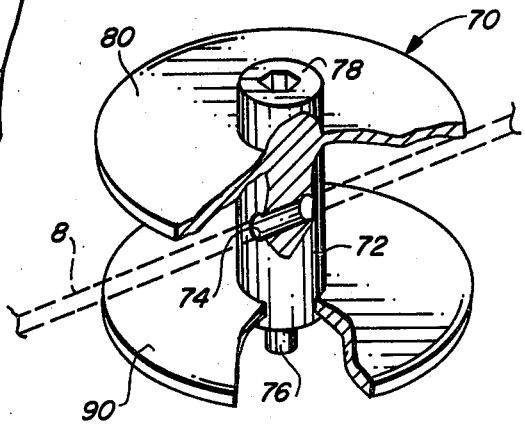
FIG. 7
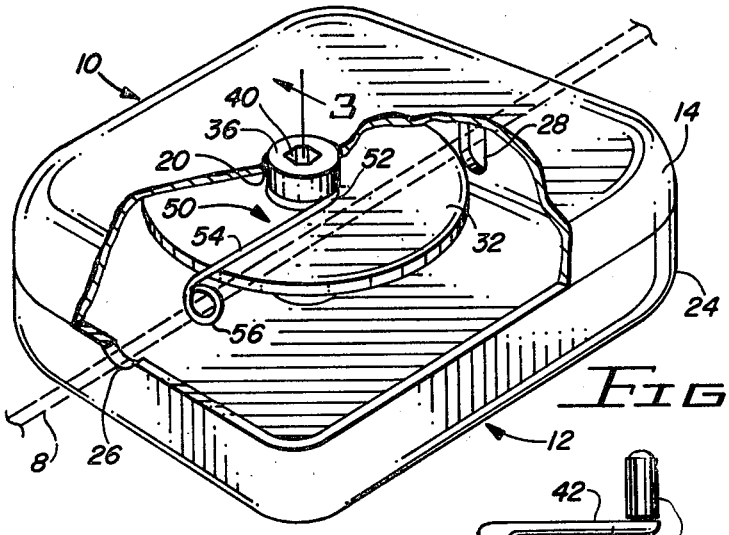
FIG. 2
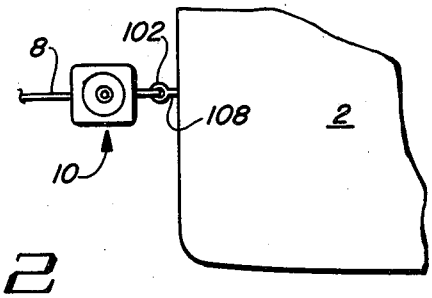
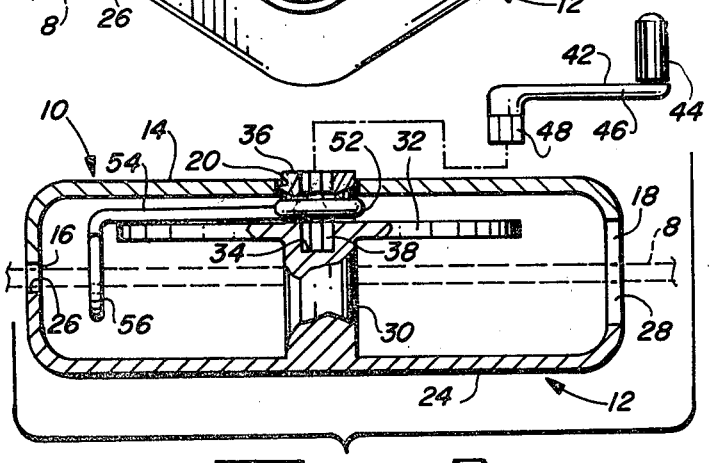
FIG. 3
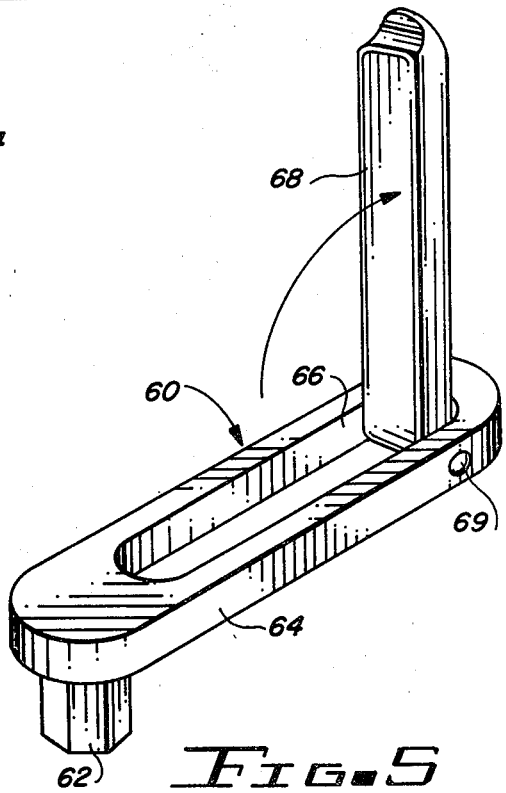
FIG. 5
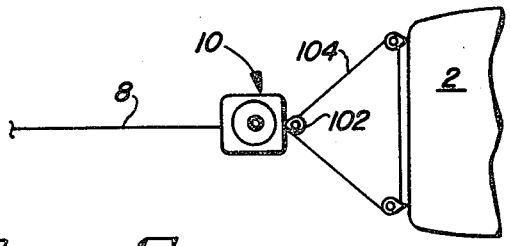
FIG. 6

WATER SKI TOW ROPE REEL APPARATUS

BACKGROUND OF THE INVENTION

1. Field of the Invention

This invention relates to water ski tow ropes, and, more particularly, to a water ski tow rope housing for storing a tow rope when not in use.

2. Description of the Prior Art:

Water ski tow ropes in contemporary use are usually simply coiled for storage within the boat when not in use. The coiled rope presents a problem in the boat for several reasons, such as getting in the way of the occupants of the boat if the rope is not stored in a locker, and getting fouled whether stored in a locker or not, which makes it rather difficult to unwind or uncoil properly without tangles in the rope. Moreover, there are inherent difficulties, generally speaking, in both coiling and uncoiling the rope.

To overcome some of the problems associated with water ski tow ropes, such as those enumerated in the preceding paragraph, several different types of reels have been proposed. However, the reels of the prior art are secured to the tow boat and accordingly present other problems. One of the problems associated with the reel secured to a boat is the evening out of the strain on the rope, or the symmetrical loading of the rope, for towing purposes. This problem, in turn, has been considered, and several suggestions have been proposed. Examples of some of the reel type apparatus, and the solution to the symmetrical loading of a tow rope, are illustrated in various U.S. Patents. Among the U.S. patents which have considered the problems U.S. Pat. No. 2,998,796. The '796 patent discloses a fixed reel secured to a boat. The tow rope is wound about the reel when the tow rope is not in use. The tow rope actually is in two sections secured together by a snap swivel hook for ease in securing the tow rope to the reel. That is, the tow rope consists of two independent ropes, one a relatively short length of rope, and one a relatively long length of rope. When the long length of rope is unwound from the reel, it is secured to the short rope to comprise a single tow rope.

Another exemplary patent is U.S. Pat. No. 3,006,309. The '309 patent discloses a reel secured to the stern section of a boat. The reel pivots into and out of use in storage positions, as desired. The reel acts as a frame or harness between the two rope and the boat when the tow rope is in its use position.

U.S. Pat. No. 3,021,088 discloses a tow rope reel which includes a guide for winding the tow rope about the reel for storage purposes. The reel is secured to the boat, but part of the reel pivots to allow the tow rope to be secured to the boat through a bridle arrangement for towing purposes. The bridle arrangement is one solution to the problem of utilizing a reel for a tow rope and yet having a symmetrical pull on the tow rope to the boat for towing a water skier.

U.S. Pat. No. 3,041,996 discloses a tow rope system using a reel secured to the boat and another type of harness or bridle system for transferring the actual pulling force on the rope to the boat. The '996 patent provides one illustration, and the '088 patent provides another illustration of attempts to solve the symmetrical load or force problem discussed above, as well as the reel and storage problem for a tow rope.

U.S. Pat. No. 3,113,547 discloses a fixed reel system secured to a boat which utilizes an arm through which the tow rope extends between the boat and the reel. The tow rope is secured directly to the boat, and it extends through an arm secured to the reel. The arm is in direct line with the point of securement of the tow rope to the boat when the tow rope is in use. When it is desired to wind the tow rope about the reel, the arm is used as a guide to feed the rope onto the reel.

U.S. Pat. No. 3,232,555 discloses a type of reel using a motor for powering the reel. The reel is secured to the boat and the tow rope extends from the reel through the transom of the boat to its use position. The rope includes a knot which limits the movement of the rope out of the boat, and accordingly no direct strain is placed on the reel when the tow rope is in use.

U.S. Pat. No. 3,494,570 discloses another type of water ski tow rope apparatus utilizing a reel secured to the boat and a connection at the boat and on the rope for transferring the towing force from the rope to the boat.

U.S. Pat. No. 3,498,563 discloses another type of reel system utilizing an arm in a manner somewhat similar to the arm employed in the '547 patent discussed above. The reel in the '563 patent is secured to the stern of a boat, and a harness or bridle system is secured to the tow rope for transferring forces in a symmetrical manner to the boat and away from the reel.

A winding reel for a water ski tow rope, with the reel again secured to the boat, is disclosed in U.S. Pat. No. 3,638,876. Part of the reel is rotatable in the '876 patent, and is spring biased to a center position.

It will be noted that the reel apparatus of each of the above discussed patents are secured to a boat, and are accordingly in a fixed position. While some of the reels may pivot, or otherwise move, nevertheless they are secured substantially permanently to a boat. The apparatus of the present invention is not fixed to a boat. The apparatus is portable in that it may be disposed at any convenient location in the boat for storage purposes. Moreover, the reel is not secured to the boat, but is "free" and is disposed out of the boat while the tow rope is in use. When the tension strain is taken off of the tow rope, both the rope and the reel apparatus fall to the surface of the water and remain there. The reel apparatus is floatable and accordingly will not sink. By using the reel apparatus of the present invention, the rope may be secured directly to the boat without requiring any additional apparatus, such as a bridle or harness adaptation, or a collar on the rope, or a knot on the rope, as illustrated in some of the patents discussed above.

SUMMARY OF THE INVENTION

The invention described and claimed herein comprises a housing for water ski tow rope storage and a reel within the housing on which the tow rope is wound for storage purposes. The tow rope extends through the housing so that one end of the tow rope may be secured directly to a boat and the other end of the tow rope may be used by a skier without placing undue tension or strain on the housing or the reel while the tow rope is in use.

Among the objects of the present invention are the following:

To provide new and useful water ski tow rope apparatus;

To provide new and useful apparatus for storing water ski rope;

To provide new and useful reel apparatus for storing a tow rope;

To provide new and useful apparatus for winding a tow rope for storage purposes;

To provide new and useful reel apparatus for a tow rope having a housing through which the tow rope extends and which housing is disposed about the reel; and To provide new and useful water ski tow rope apparatus including a housing through which the tow rope extends and a reel within the housing on which the tow rope is wound for storage purposes and on which the tow rope is unwound for use purposes.

BRIEF DESCRIPTION OF THE DRAWING

FIG. 1 is a perspective view of the apparatus of the present invention shown in its use environment.

FIG. 2 is a perspective view of the apparatus of the present invention, partially broken away, illustrating the various elements of the invention.

FIG. 3 is a view in partial section of the apparatus of FIG. 2, taken generally along line 3—3 of FIG. 2.

FIG. 4 is a perspective view, with a portion broken away, of an alternate embodiment of a portion of the apparatus of the present invention.

FIG. 5 is a perspective view of a handle usable with the apparatus of the present invention.

FIG. 6 is a top view illustrating the securing of the apparatus of the present invention to a boat.

FIG. 7 is a top view illustrating an alternate method of securing the apparatus of the present invention to a boat.

DESCRIPTION OF THE PREFERRED EMBODIMENT

FIG. 1 is a perspective view of a boat 2 towing a skier 4 on a water ski 6 by a rope 8 which extends through a reel apparatus 10. The rope 8 extends from the boat and through the reel apparatus 10 of the present invention to the skier 4. The rope 8 is secured to the boat 2 for towing purposes. FIG. 2 is a perspective view of a reel apparatus 10 with a portion broken away to show the various elements which comprise the reel apparatus 10. FIG. 3 is a view in partial section of the reel apparatus 10 of FIG. 2 taken generally along line 3—3 of FIG. 2. For the following discussion, reference will be made to FIGS. 1, 2, and 3.

The reel apparatus 10 includes a housing 12 to, and through, which the rope 8 extends. The housing includes two portions, an upper portion 14 and a lower portion 24. The two portions or sections 14 and 24 of the housing 12 may be secured together in any well known and appropriate manner, not shown, such as by screws, bolts, etc. The housing 12 is preferably made of an elastomeric material, such as any of several different kinds of plastics, which are generally light and impervious to both fresh and salt water. Corrosion will generally have no effect on a plastic housing, except the gradual buildup of salt accumulating on the surfaces. If the housing 10 contacts the water, whether it be empty, with the rope 8 unwound therefrom, as shown in FIG. 2, or whether the reel be with the rope wound therein for storage purposes, not shown, the reel will float and will not sink in water. Generally speaking, the rope 8 typically used for water ski towing purposes, is also made of elastomeric material which is impervious to water, corrosion, etc., and which floats.

The upper housing section 14 includes an aperture portion 16 at one end, and a slot portion 18 at its opposite end. The aperture 16 defines a semicircle, and comprising one-half of an aperture through which the rope extends. Similarly, the slot 18 comprises one-half of a total elongated slot through which the rope 8 extends for securing the rope to the boat 2. The slot 18 is preferably larger, lengthwise, or vertically, than is the aperture 16.

The lower portion 24 of the housing 12 is substantially identical to the upper portion 14. It includes mating portions or halves for the aperture 16 and slot 18 discussed in the preceding paragraph, namely a lower aperture portion 26 and a lower slot portion 28. The aperture portion 26 is also generally semicircular in configuration and mates with the upper aperture portion or half 16 to define a generally circular aperture through which the rope 8 extends. Similarly, the slot portion or half 28 mates with the upper slot portion or half 18 to define an elongated slot, best shown in FIG. 3, through which the rope 8 extends to connect to the boat 2, as shown in FIGS. 1 and 2. The aperture 16/26 and the slot 18/28 are aligned with each other as best shown in FIGS. 2 and 3 so that the rope 8 will extend directly, or straight, through the housing 12 when the rope is unwound, in its use position, for towing purposes.

The upper housing portion 14 also includes an aperture 20 which extends through the top of the housing 12, remote from the aperture and slot 16 and 18, respectively. The top aperture 20 is for winding purposes, as will be discussed in detail below.

Within the lower housing portion 24, and generally centrally located with respect to the housing portion 24, is a vertically extending bobbin or core 30. The bobbin or core 30 is preferably fixed with respect to the lower housing portion 24. The rope 8 is wound about the bobbin or core 30. As is best shown in FIG. 2, and as may be understood from FIG. 3, the rope 8 extends through the housing 12 and is disposed on one side of the bobbin or core 30. If desired, the bobbin or core 30 may be slightly offset from the center of the housing 12 in order to allow the rope 8 to pass through the housing in generally a straight line. Alternatively, the aperture portions 16 and 26 and the slot portions 18 and 28 may be disposed slightly off center with the bobbin or core 30 disposed in the center, to allow the rope to extend straight through the housing 12.

Secured to the upper portion of the bobbin or core 30 is a guide plate 32. The guide plate 32 is preferably generally circular in configuration, as best shown in FIG. 2. The rope 8 is wound about the bobbin or core 30 beneath the guide plate 32. The guide plate 32 is disposed within the upper portion 14 of the housing 12, as best shown in FIG. 3.

Centrally located with respect to the guide plate 32 and the bobbin or core 30 is a bore 34. The bore 34 extends downwardly from the guide plate 32. It is preferably round or cylindrical and acts as a bearing or bushing to receive a shank portion 38 of a winding stem 36. The winding stem 36 extends upwardly through the aperture 20 in the upper half 14 of the housing 12. The shank portion 38, which extends downwardly from the winding stem 36, is substantially less in diameter than the stem 36.

A square, or perhaps hexagonal, bore 40 extends downwardly through the winding stem 36. The bore 40 receives a stem 48 of a handle 42 for purposes of winding the rope 8 onto the core 30. The winding stem 36 is journaled for rotation in the bore 34. The core 30 is fixed in position, while the winding stem 36 rotates in response to movement of the handle 42 to wind the rope 8 about the core 30.

The handle 42 includes a vertical arm 44 which is preferably grasped by the user of the apparatus, and the vertical arm 44 is in turn secured to a horizontal arm 46. The stem 48 extends downwardly from the horizontal arm 46 remote from the arm 44. The arm 44 and the stem 48 are generally parallel to each other, but extend in opposite directions from each other. The stem 48 is of a square or hexagonal configuration to mate with the bore 40 for winding purposes. The handle 42, if desired, may be removable from the winding stem 36 when the rope is extended, as shown in FIG. 1, during water ski towing operations. The removal of the handle 42 thus allows for the streamlining of the reel apparatus 10 during use operations.

A winding guide 50 is secured to the winding stem 36 within the housing 12. The rope 8 extends through the winding guide and the winding guide rotates in response to movement of the handle 42 with the winding stem 36.

The winding guide 50 includes a loop 52 secured to the stem 36. The loop 52 may extend about the stem 36 or may extend through the stem 36, so as to secure the winding guide 50 to the winding stem 36 for joint movement. Extending generally outwardly from the loop 52 is an arm 54. The length of the arm 54 is slightly greater than the radial width of the guide plate 32, so that the winding guide 50 is unhampered in its rotary movement by the plate 32.

Extending downwardly from the arm 54 is a loop 56. The rope 8 extends through the loop 56. The loop 56 acts as a guide for winding and unwinding the rope about or from the core 30. When the tow rope 8 is unwound or "out", as shown in FIG. 1 and as illustrated in phantom in FIGS. 2 and 3, the loop 56 is substantially perpendicular to the longitudinal axis of the rope 8 so as to provide a generally direct, unhampered, path for the rope through the apparatus 10.

The housing 12 is generally configured as a relatively square or squared pair of dishes inverted to face each other, with the winding core disposed within the pair of inverter dishes. The housing 12 is preferably streamlined so as to provide minimum air foil problems when the apparatus is in a use environment, such as is shown in FIG. 1, and yet allow for the winding of a substantial length of water ski tow rope within the apparatus for storing purposes. It will be noted that the rope 8 preferably extends through the reel apparatus 10 so that there will be a direct connection between the rope 8 and the boat 2, as shown in FIG. 7, or to a rope or bridle 104 secured to the boat 2, as shown in FIG. 6. This eliminates the potential problem of stress being applied directly to the reel apparatus 10. Thus, while the tow rope 8 is being used, as shown in FIG. 1, there is no strain or force acting directly on or through the reel apparatus 10. Rather, the rope 8 extends through the reel apparatus 10 and is connected to a harness or bridle 104 through a ring 102 secured to one end of the rope 8. The ring 102 is disposed remote from the skier 4, as shown in FIG. 1. The reel apparatus 10, when the rope 8 is in its use position, may thus move freely on the rope 8, and is not directly connected to the bridle or harness 104 or to the ring 102. The use of the ring 102 and the bridle 104 is well known in water ski art.

In FIG. 3, it will be noted that the lines separating the upper housing portion 14 from the lower housing portion 24, at the center of the housing 12, is not shown. It has been omitted for clarity purposes in order to show a portion of the rope 8, in phantom, extending through the housing.

When skiing has been completed, and it is desired to wind the rope 8 within the housing 12, the handle 42 is secured to the winding stem 36 by placing the stem 48 in its mating bore 40, and by then rotating the handle 42. Rotation of the handle 42 causes the winding stem 36 and the winding guide 50 to rotate within the housing about the bobbin or core 30. Since the rope 8 extends through the loop 56, the rope 8 moves about the core 30 as the winding guide 50 rotates. The rope 8 is secured to the ring 102, or the like, which will not move through the mating slots 18 and 28. However, the opposite, or long, end of the rope 8 extends through the mating aperture portions 16 and 26 and accordingly will wind itself about the core 30 as the winding guide 50 rotates about the core 30. The loop 56 is relatively smooth and thus it moves easily over the relatively fixed portion or end of the rope 8 during the winding process. The fixed portion of the rope 8 accordingly remains extending outwardly through the mating slot portions 18 and 28, with the ring 102 disposed against the housing 12. The ring 102 acts as an anchor or block to anchor the "short" end of the rope to the housing 12, thus allowing the "skier portion" of the rope to be wound about the core 30. After one or two rotations of the winding guide 50, the "short" end of the rope 8 will be disposed in the lower part of the slot 28, and thus out of the way for continued winding of the "long" or "skier" portion of the rope 8 about the core 30. As the rope 8 continues to be wound about the core 30, the diameter of the wound portion of the rope increases. The length of the arm 54, and the radius or diameter of the guide plate 32 is such that the entire length of the rope 8 will be disposed within the housing. The overall diameter, that is, the overall diameter of the wound or coiled rope, should preferably be less than the diameter of the plate 32 and thus of the length of the arm 54. With no force on the rope 8 which extends through the mating aperture portions 16 and 26, the rope follows the winding guide 56 about the core 30 until the entire length of the tow rope 8 is disposed within the housing 12.

FIG. 4 is a perspective view of an alternate embodiment of the winding apparatus included in FIGS. 2 and 3. FIG. 4 comprises a perspective view, partially broken away, of a movable or rotatable reel 70 which may rotate within the housing 12, shown in FIGS. 2 and 3. The reel 70 includes a pair of plates 80 and 90 spaced apart vertically from each other and secured to a central shaft 72. The shaft 72 defines a winding bobbin or core about which the rope 8 may be wound. The plates 80 and 90 are integrally secured to the shaft 72, and thus rotate with the shaft.

An aperture 74 extends diametrically through the shaft 72, about half way between the plates 80 and 90. Beneath the plate 90 is a reduced diameter portion 76 of the shaft 72. The reduced diameter portion 76 defines a pin or shank which may extend into a mating bore (not shown) within the lower housing portion 24. The pin and bore journal the reel 70 for rotation within the housing 12.

Above the upper plate 80, and extending downwardly or inwardly with respect to the shaft 72, is a bore 78. The bore 78 is preferably square or hexagonal in configuration to receive a mating stem of a handle, such as the handle 42 discussed above, for rotating the reel 70. The diameter of the aperture 20 in the top or upper housing portion 14 of the housing 12 is preferably dimensioned so as to allow the upper portion of the shaft 72, above the plate 80, to extend through the aperture, comparable to the upward and outward extension of the winding stem 36, as shown in FIGS. 2 and 3. If desired, the portion of the shaft 72 between the plates 80 and 90 may be different in diameter from that portion of the shaft 72 which extends upwardly from the plate 80 and through the aperture 20.

The tow rope 8 extends through the aperture or bore 74 in the shaft 72 and moves freely therethrough. Or, to put it in the opposite manner, the shaft 72, and accordingly the reel 70, and the housing 12, moves easily relative to the tow rope 8.

For winding purposes, the reel 70, and accordingly the housing 12, is moved along the rope 8 so as to be centrally located with respect to the overall length of the tow rope 8. The reel apparatus 10, when using the reel 70, is thus preferably located at about the midpoint of the rope 8 when it is desired to wind the rope for storage purposes, since the rope will be wound in both directions from the reel 70 outwardly. A handle, such as a handle 42 shown in FIG. 3, or a handle such as a handle 60 shown in FIG. 5, and discussed below, is inserted into the bore 78 and rotation or turning of the handle causes a corresponding turning of the reel 70. With the reel 70 centrally located at the midpoint of the rope 8, the rope 8 will be wound about the shaft 72 which, with the plates 80 and 90, thus defines a bobbin about which the rope is wound. With the rope being wound from both directions, or from either side of the reel 70, the rope 8 will be wound in a different manner from that discussed above in conjunction with FIGS. 2 and 3. In FIG. 4, the reel 70 rotates to wind the rope 8 from both directions. In FIGS. 2 and 3, the core 30 is fixed and the guide 50 moves the rope about the fixed core 30.

The handle 60 of FIG. 5 comrises an alternate embodiment of a handle usable with the apparatus of the present invention. The handle 6 includes a stem 62 which is appropriately configured to mate with the bore 40 or the bore 78, as discussed above, for winding purposes. The stem 62 is in turn secured to an arm 64 and the two portions are substantially perpendicular to each other. The arm 64 includes a slot 66 which receives a pivoting vertical arm 68. The arm 68 defines a portion of the handle 60 which is grasped by a user. When the handle 60 is not being used for winding purposes, the arm 68 pivots downwardly on a pivot pin 69 to nest within the slot 66. With the pivoting arm 68, the handle 60 is more compact than is the handle 42 which is shown in FIG. 3.

FIG. 6 is a top view illustrating the employment of the reel apparatus 10 with the tow rope 8 and the boat 2. On the end of the tow rope 8, remote from the water skier (see FIG. 1) is a ring 102. The ring 102 is used to secure the tow rope 8 to the boat 2 through a bridle arrangement 104. The bridle 104 comprises a rope secured to the boat 2 through a two-point suspension system. That is, the ends of a rope portion of the bridle 104 is fixedly secured to the boat 2 at two points along the transom or stern end of the boat. The two securing points are spaced apart from each other, and are preferably at opposite sides of the transom. The spacing between the two securement or suspension points defines the base of a triangle, with the rope between the ring 102 and the two suspension points defining the sides of the triangle. Obviously, the ring 102 is movable along the rope, which allows the forces to act symmetrically with respect to the boat on straight runs, and allows the ring 102, and accordingly the rope 8, to move along the bridle 104 in turns.

As will be understood from FIGS. 2 and 3, the reel apparatus 10 is movable along the rope 8 between the ring 102 and the skier. By placing a collar, or the like, (not shown) at some point along the rope 8 between the skier and the reel apparatus 10, the movement of the reel apparatus 10 may be eliminated. It may be preferable, as shown in FIG. 6, for the reel apparatus 10 to remain fairly close to the ring 102 when the rope 8 is being used for towing purposes, as shown in FIG. 1. As discussed above, the ring 102 is larger than the combined slots 18 and 28 (see FIG. 3) and the ring 102 accordingly will not pass through the reel apparatus 10. The reel apparatus 10 therefore is movable between the ring 102 and the skier, or between the ring 102 and a collar, or the like, placed on the rope 8 after the rope is unwound from the reel.

An alternate method of securing a rope 8 to a boat is illustrated in FIG. 7. FIG. 7 is a top view showing a single point attachment between the rope 8 and the stern of the boat 2 and the ring 102, secured to the rope 8, is in turn secured to a ring 108. There are advantages in the single point suspension of FIG. 7, as well as in the two-point suspension shown in FIG. 6. Regardless of what type of suspension is used for the rope 8, the reel apparatus 10 will function as discussed above for storage purposes of the rope 8 when the rope is not being used.

While both handles 42 and 60 are removable handles, it will be understood that a handle may be integral with the winding assembly, if desired. If an integral handle were used, it may be advantageous for such handle to include a portion which snaps into an aperture for retaining the handle in a fixed position while the rope is being used for towing purposes.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Reel apparatus for a two rope, comprising, in combination:

a rope;

housing means movable on the rope;

first aperture means in the housing means through which the rope extends;

second aperture means in the housing means remote from the first aperture and defining a slot through which the rope extends;

core means disposed within and secured to the housing means about which the rope is wound, including a core secured to the housing means, and
a guide plate secured to the core;
winding means for winding the rope about the core means including
a winding stem rotatable about the core means,
an arm secured to the winding stem and movable therewith,
a loop secured to the arm through which the rope extends, and
handle means for rotating the winding stem and the arm and the loop for winding the rope about the core means between the housing means and the guide plate.

2. The apparatus of claim 1 in which the core means further includes a bore for receiving the winding stem and in which the winding stem rotates.

3. The apparatus of claim 1 in which the handle means is removably secured to the winding stem.

4. Reel apparatus for a tow rope, comprising, in combination:
a rope;
housing means movable on the rope;
first aperture means in the housing means through which the rope extends;
second aperture means in the housing means remote from the first aperture and defining a slot through which the rope extends;
core means comprising a reel rotatably disposed within and secured to the housing means about which the rope is wound, including
a core,
a first plate secured to the core,
a second plate secured to the core and spaced apart from the first plate, and
an aperture extending through the core between the first and second plates through which the rope extends; and
winding means for winding the rope about the core means.

5. The apparatus of claim 4 in which the winding means rotates the reel for winding the rope about the core between the first and second plates.

* * * * *